US006502292B1

(12) United States Patent
Hartley

(10) Patent No.: US 6,502,292 B1
(45) Date of Patent: Jan. 7, 2003

(54) APPARATUS AND METHOD FOR PREPARING AN EXCAVATOR STICK FOR TRANSPORT

(76) Inventor: William E. Hartley, 505 S. Avington Ave., West Covina, CA (US) 91790

( * ) Notice: Subject to any disclaimer, the term of this patent is extended or adjusted under 35 U.S.C. 154(b) by 108 days.

(21) Appl. No.: 09/650,320

(22) Filed: Aug. 29, 2000

Related U.S. Application Data

(60) Provisional application No. 60/171,791, filed on Dec. 22, 1999.

(51) Int. Cl.[7] ..... B23P 19/00

(52) U.S. Cl. ..... 29/426.5; 29/426.1; 29/426.3; 29/700; 212/177; 212/200; 212/201; 212/202; 212/226

(58) Field of Search ..... 29/426.1, 426.3, 29/426.4, 426.5, 700; 212/175, 176, 177, 178, 179, 199, 200, 201, 202, 204, 223, 226

(56) References Cited

U.S. PATENT DOCUMENTS

| | | | | | |
|---|---|---|---|---|---|
| 2,593,843 | A | * | 4/1952 | Cannon | 29/33 R |
| 3,874,533 | A | * | 4/1975 | Montgomery et al. | 414/723 |
| 4,064,615 | A | * | 12/1977 | Anderson | 29/426.2 |
| 4,524,873 | A | * | 6/1985 | McGowan | 212/177 |
| 4,826,385 | A | * | 5/1989 | Martinsen | 414/373 |
| 4,905,363 | A | * | 3/1990 | Boyenval | 29/403.2 |
| 5,214,866 | A | * | 6/1993 | Kackmack | 37/305 |
| 5,335,406 | A | * | 8/1994 | Van Den Mosselaar et al. | 29/426.3 |
| 6,260,252 | B1 | * | 7/2001 | Wijsman et al. | 29/426.1 |

FOREIGN PATENT DOCUMENTS

| | | | | |
|---|---|---|---|---|
| WO | WO 89/02957 | * | 4/1989 | E02F/3/96 |

* cited by examiner

*Primary Examiner*—David P. Bryant
*Assistant Examiner*—Essama Omgba
(74) *Attorney, Agent, or Firm*—Fulbright & Jaworski LLP

(57) ABSTRACT

An apparatus for preparing an excavator stick for transport includes a base supporting two symmetrically spaced platforms for use by a mechanic. The base comprises a saddle at one end for holding the back portion of the excavator stick which has been detached from the boom of the excavator, an excavator stick point support bracket at the opposite end of the base for removably engaging the front portion of the excavator stick which has already been detached from the excavator bucket, and an extendible fork-shaped excavator stick support member disposed between the saddle and the excavator stick point support bracket for supporting the body of the excavator stick in the excavator stick support eye region of the excavator stick during preparation for transport. The saddle and excavator stick point support bracket are mounted on a pair of parallel rails mounted on symmetrically spaced parallel cross support bars with the fork-shaped excavator stick support member pivotally mounted on one of the cross support bars. The excavator stick support member can be raised or lowered in a vertical plane as needed by a base-integrated come-along which is handled by the mechanic. The excavator stick is prepared for transport in a series of steps including removably engaging the front end of the excavator stick in the excavator stick point support bracket with a pin, raising the fork-shaped excavator stick support member to removably engage the excavator stick with another pin in the excavator stick support eye region, unhinging the excavator stick from the boom, disengaging the fork-shaped excavator stick support member from the excavator stick support eye region of the excavator stick, lowering the unhinged back portion of the excavator stick onto the saddle and strapping the lowered excavator stick to the base in preparation for transport.

17 Claims, 5 Drawing Sheets

FIG. 1
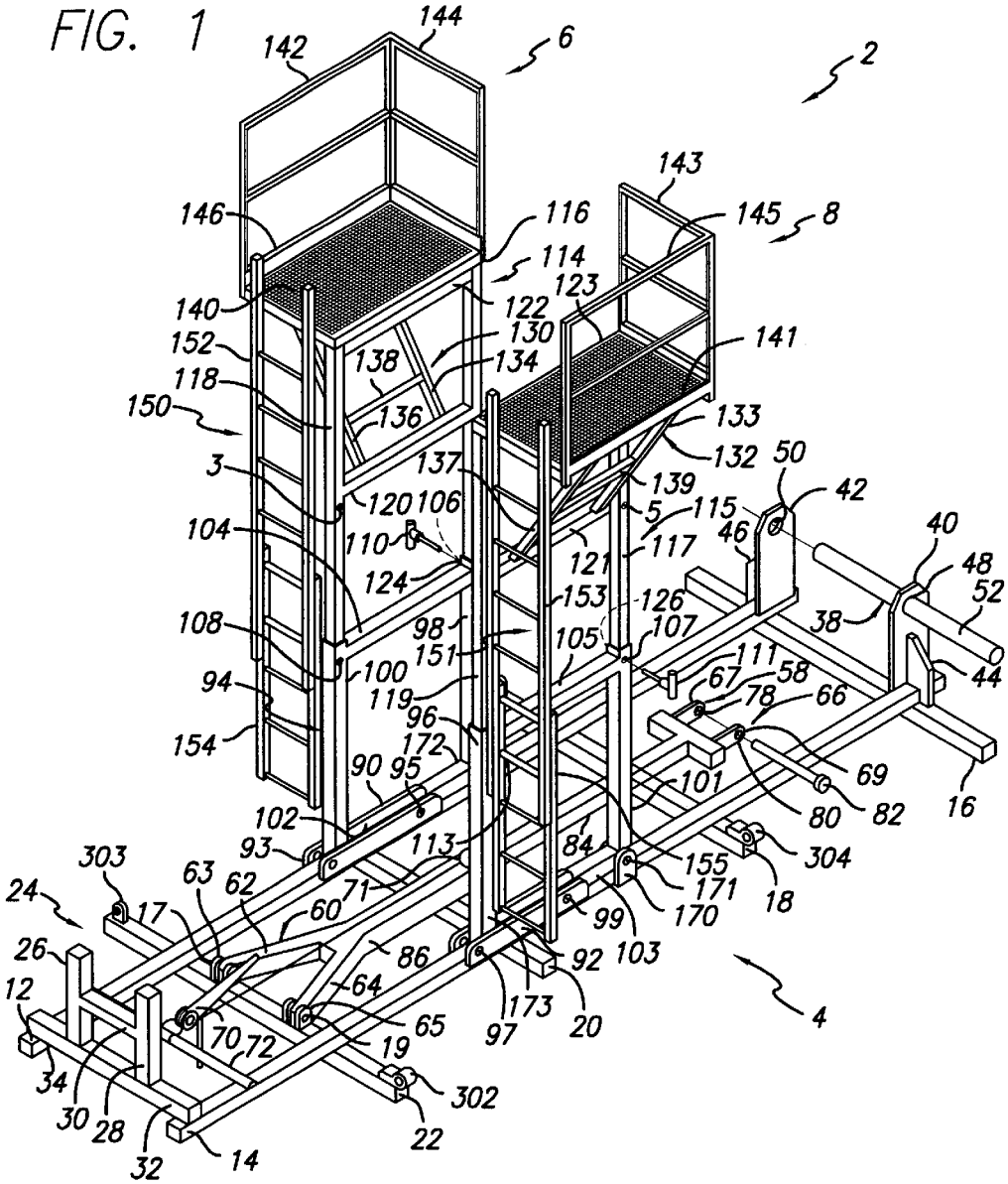
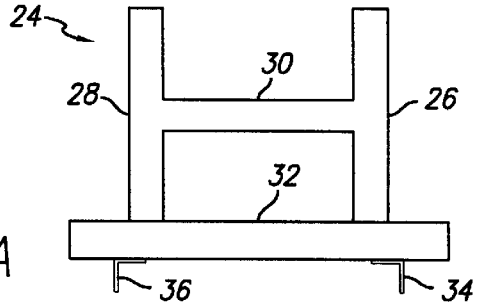
FIG. 1A

APPARATUS AND METHOD FOR PREPARING AN EXCAVATOR STICK FOR TRANSPORT

This application claims the benefit of United States Provisional Patent Application, Ser. No. 60/171,791, filed Dec. 22, 1999, the contents of which is incorporated herein by reference.

BACKGROUND OF THE INVENTION

1. Field of the Invention

The present invention relates generally to the field of excavating equipment and more particularly to an apparatus and method for preparing an excavator stick for transport from one site to another.

2. Prior Art

Conventional techniques for preparing an excavator stick for transport from one site to another involve a significant amount of labor and time expenditure on part of the operator. The excavator stick must be decoupled from the boom of the excavator manually by several mechanics in a series of steps including removal of the stick cylinder pin and removal of the boom pin (also commonly known as "stick pin"). A mechanic must be elevated to boom pin height by a loader, forklift or ladder which is a risky operation in terms of safety. With the mechanic elevated, a sledgehammer is then used to hammer out the boom pin which may lead to damage of the boom pin itself. The stick is then lowered on the ground where it is often flipped on a different side risking damage to the bucket, hydraulic lines and associated hardware.

Occasionally, when the stick cylinder pin is removed, it is jammed into dirt or loose gravel, and debris gets into the bushing, seal, grease-sleeve (in the vacant bucket pin opening) which may lead to significant down time used for cleaning the bushing, seal and sleeve. Also, every time the excavator bucket is engaged and released, the bushing, seal, sleeve and pin are subjected to pitting and grinding abrasive action.

Therefore, the need arises for a novel apparatus and method for preparing an excavator stick for transport which would would eliminate the risk of damage to the excavator stick and associated hardware, reduce significantly labor costs and down time and comply with or exceed current OSHA fall protection safety standards.

SUMMARY OF THE INVENTION

"The present invention is directed to an apparatus for preparing an excavator stick for transport, the excavator stick having a front portion uncoupled from an excavator bucket, a back portion removably coupled to an excavator boom, and an excavator stick support eye region between the front and back portions, the apparatus comprising a base for accommodating and supporting the excavator stick during transport means for removably coupling the front excavator stick portion to the base means for uncoupling the back excavator stick portion from the excavator boom means for supporting the uncoupled back portion of the excavator stick over the base means for holding the uncoupled back portion of the excavator stick onto the base and means for securing the excavator stick to the base in preparation for transport."

These and other aspects of the present invention will become apparent from a review of the accompanying drawings and the following detailed description of the preferred embodiments of the present invention.

BRIEF DESCRIPTION OF THE DRAWINGS

FIG. 1 is a perspective view of an apparatus for preparing an excavator stick for transport in accordance with the present invention;

FIG. 1*a* is a side plan view of the saddle portion of the apparatus for preparing an excavator stick for transport of FIG. 1 in accordance with the present invention;

DETAILED DESCRIPTION OF THE PREFERRED EMBODIMENTS

Figure 2:
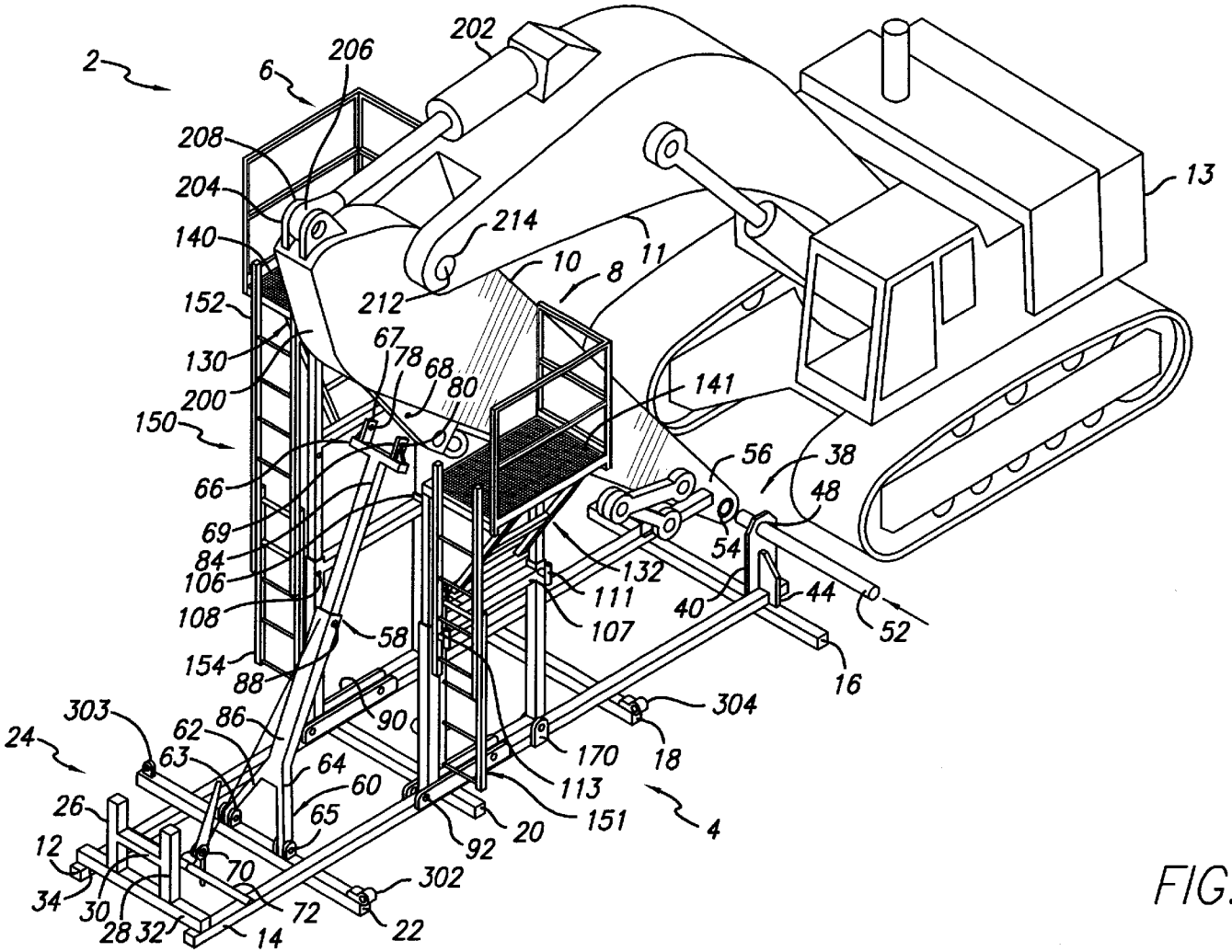
FIG. 2 is a perspective view of an excavator and the apparatus of FIG. 1 in the process of preparing an excavator stick for transport in accordance with the present invention.

Hereinafter, some preferred embodiments of the present invention will be described in detail with reference to the related drawings of FIGS. 1–5. Additional embodiments, features and/or advantages of the invention will become apparent from the ensuing description or may be learned by the practice of the invention.

In the figures, the drawings are not to scale and reference numerals indicate the various features of the invention, like numerals referring to like features throughout both the drawings and the description.

The following description includes the best mode presently contemplated for carrying out the invention. This description is not to be taken in a limiting sense, but is made merely for the purpose of describing the general principles of the invention.

Referring more particularly to FIG. 1, an apparatus for preparing an excavator stick for transport, generally referred to by reference numeral 2, is shown for use in accordance with the general principles of the present invention. Apparatus 2 comprises a base 4 supporting two symmetrically spaced vertically extended platforms 6 and 8, respectively, for use by a mechanic during the course of preparing an excavator stick such as excavator stick 10 for transport (FIGS. 2–5). Platforms 6 and 8 are preferably constructed to be compliant with current OSHA safety standards.

Base 4 includes a pair of substantially parallel steel frame rails 12, 14 mounted on symmetrically spaced long and short parallel steel cross support bars 16, 18, 20 and 22. Long cross support bars 16 and 22 are preferably welded to the underside of frame rails 12, 14 substantially at each end of frame rails 12, 14 to provide structural stability for platforms 6, 8 when platforms 6, 8 are fully erected. Short cross support bar 18 is preferably welded proximate to long cross support bar 16 while short cross support bar 20 is preferably welded proximate to long cross support bar 22 (FIG. 1).

Base 4 also includes a generally H-shaped steel saddle 24 preferably slip fit mounted onto rails 12, 14 substantially at the back end of base 4 as shown in FIG. 1. Saddle 24 is intended to hold the unhinged back end 200 of excavator stick 10 during transport (FIG. 5) with back end 200 of excavator stick 10 unhinged from a boom 11 (FIGS. 2–5) whereby boom 11 is mounted conventionally to the front of a hydraulic excavator 13 (FIGS. 2–5). Saddle 24 comprises a pair of vertical and generally parallel steel bars 26, 28 preferably welded at one end to a steel saddle support bar 32 and supported substantially midway by a cross support bar 30. Saddle support bar 32 is equipped with a pair of generally L-shaped steel saddle alignment brackets 34, 36 welded to the underside of saddle support bar 32 in a spaced apart relationship as shown in FIG. 1*a* for slip fit mounting saddle 24 onto rails 12, 14 (FIG. 1). The slip fit mounting means allows easy removal and relocation of saddle 24 to a different position onto rails 12, 14 as needed. Other means of mounting saddle 24 onto rails 12, 14 may be utilized, provided such mounting means do not deviate from the intended purpose and scope of the present invention.

Base 4 further includes a steel excavator stick point support bracket 38 mounted on rails 12, 14 substantially at the front end of base 4 (FIGS. 1–5). Excavator stick point support bracket 38 comprises a pair of spaced apart substantially parallel excavator stick point support bracket plates 40, 42 preferably welded at one end to each of frame rails 12, 14 as shown in FIG. 1. Bracket plate 40 is provided with a side support steel rib plate 44 preferably welded at one end to long cross support bar 16, to frame rail 14 and to the outer side of bracket plate 40 for providing structural support to mounted bracket plate 40 as shown in FIG. 1. Bracket plate 42 is provided in turn with a similar side support steel rib plate 46 (FIG. 1) welded to long cross support bar 16, to frame rail 12 and to the outer side of bracket plate 42 for providing structural support to bracket plate 42 as shown in FIG. 1. Each bracket plate 40, 42 is also provided with a generally circular aperture 48, 50 respectively, for removably accommodating a conventional steel excavator stick point pin 52 which is inserted into a counterpart excavator stick point pin aperture 54 (FIG. 2) of excavator stick 10 to support a detached (from the excavator bucket which is attached by a bucket pin and a bucket linkage pin) front end 56 of excavator stick 10 during preparation for transport (and during transport) of excavator stick 10 (FIGS. 2–5). To detach front end 56 from the excavator bucket (not shown) of excavator 13 the mechanic removes the bucket linkage pin (not shown), retracts the bucket linkage (not shown), installs a hydraulic pin press (not shown), removes the bucket pin (not shown) and chains the bucket linkage and bucket cylinder to excavator stick 10 (not shown) in preparation for transport.

Figure 3:
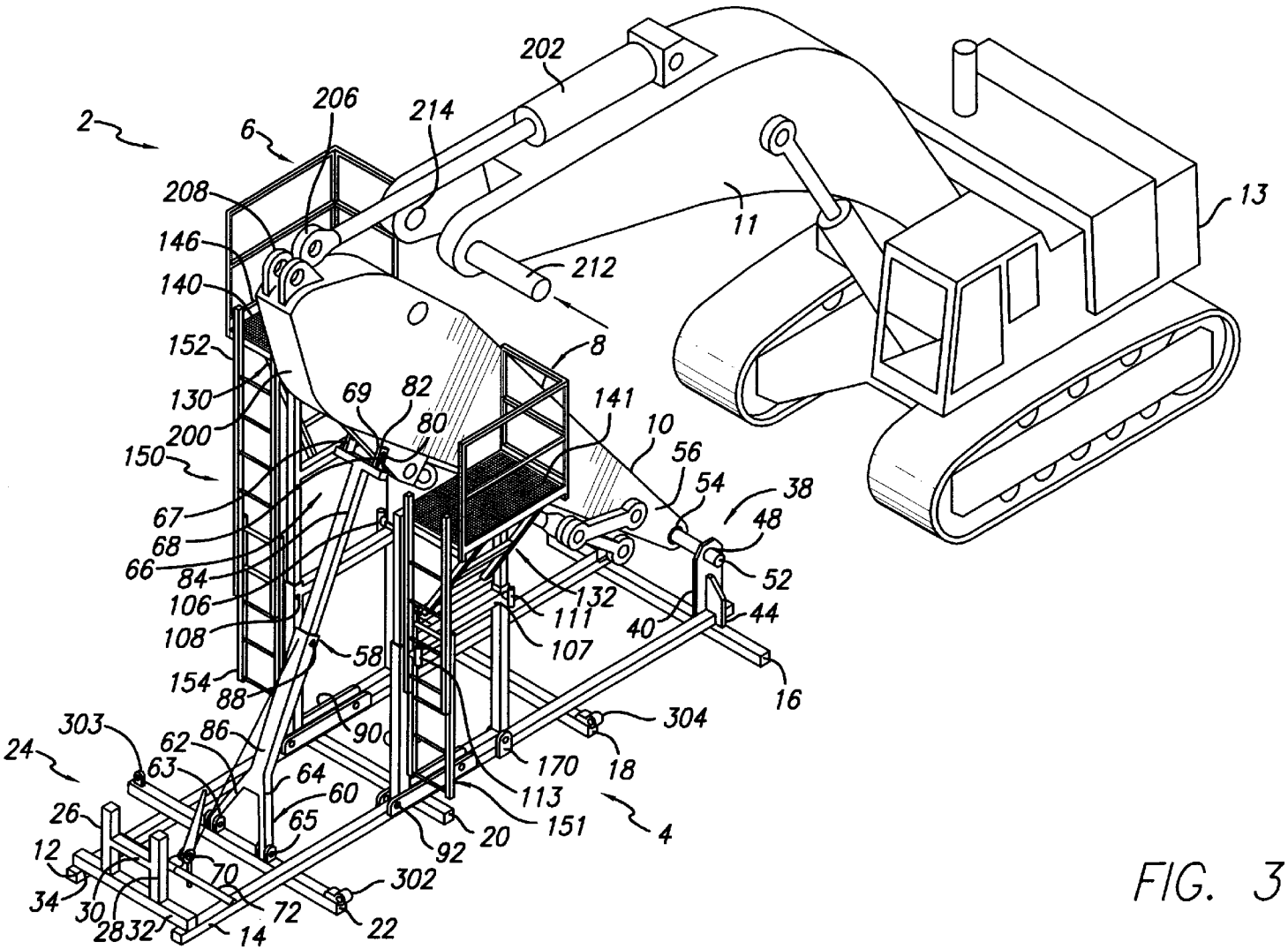
FIG. 3 is a perspective view of the excavator and the apparatus of FIG. 2 in the process of preparing an excavator stick for transport in accordance with the present invention.

As further illustrated in FIGS. 1–5, base 4 is also provided with an extendible excavator stick support member 58 substantially shaped like a fork. Fork-shaped excavator stick support member 58 is provided at one end with an excavator stick support bracket 66 for supporting excavator stick 10 during preparation for transport and is removably hinged at the other end to short cross support bar 22 via a substantially triangular base 60 including legs 62, 64 pivotally attached thereto via removable steel brackets 63, 65 and pins 17, 19, respectively. In accordance with the best mode for practicing the present invention, excavator stick support member 58 can be raised vertically about its hinged triangular base end by a mechanic using an integrated conventional 5-ton cable come-along 70 attached to a cross support bar 72 (FIG. 3) with an approximate angular raising range being generally 0°–90°. Cross support bar 72 is welded onto rails 12, 14 preferably between saddle 24 and long cross support bar 22 as shown in FIG. 1. Excavator stick support bracket 66 is preferably provided with prongs 67, 69 with each prong including a generally circular aperture 78, 80, respectively, for removably engaging an excavator stick support bracket pin 82 which is inserted in an excavator stick support eye region 68 (FIG. 2) of excavator stick 10 to support excavator stick 10 during transport preparation. Excavator stick support bracket 66 is mounted on an extendible leg 84 which is designed to slide inside a hollow base member 86 (as needed) which includes triangular base 60 (FIG. 1). Extendible leg 84 may be secured to the end of hollow base member 86 in its optimal extended position by a conventional nut/bolt connection 88 (FIGS. 2–3). Integrated come-along 70 is also attached to a hook 71 provided on top of hollow base member 86 (FIG. 1).

As illustrated in FIGS. 1–5, base 4 is further provided with a pair of platform base brackets 90, 92 preferably welded to rails 12, 14, respectively, substantially over short cross support bar 20 (FIG. 1) for removably coupling one end of platform base support frames 94, 96 to base 4 when platforms 6, 8 are fully erected (FIG. 1). Each platform base support frame (94, 96) has generally a rectangular cross section and includes a pair of long hollow support bars such as bars 98, 100 for frame 94 and bars 101, 173 for frame 96. Each pair of long support bars is supported at each end by a respective pair of short hollow cross support bars such as bars 102, 104 for frame 94 and bars 103, 105 for frame 96 as shown in FIG. 1. Short cross support bar 103 is removably coupled to platform base bracket 92 via a set of nuts/bolts 97, 99 by a mechanic. Short cross support bar 102 is in turn removably coupled to platform base bracket 90 via a set of nuts/bolts 93, 95 by a mechanic.

Figure 4:
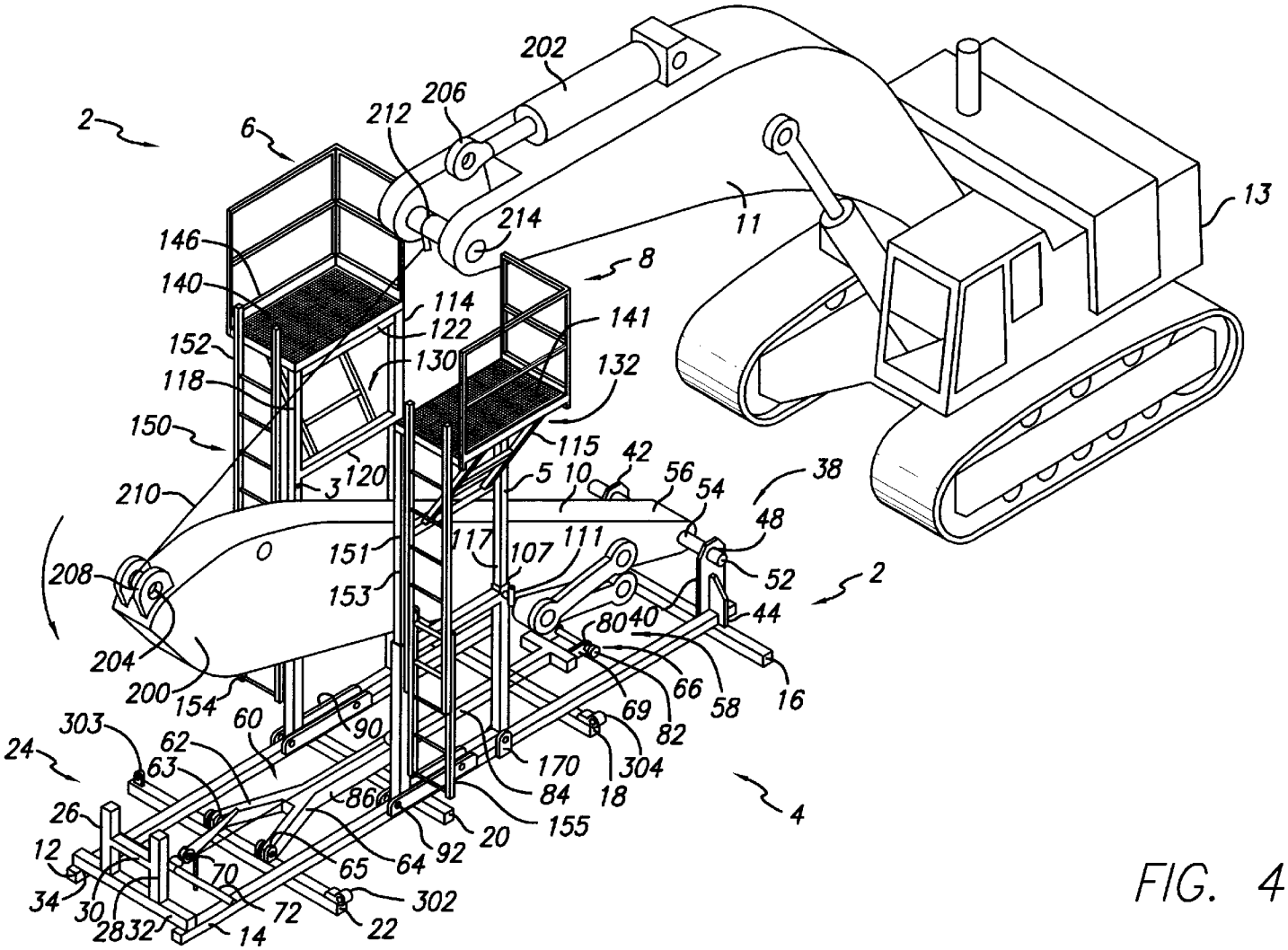
FIG. 4 is a perspective view of the excavator and the apparatus of FIG. 3 in the process of preparing an excavator stick for transport in accordance with the present invention.
Figure 5:
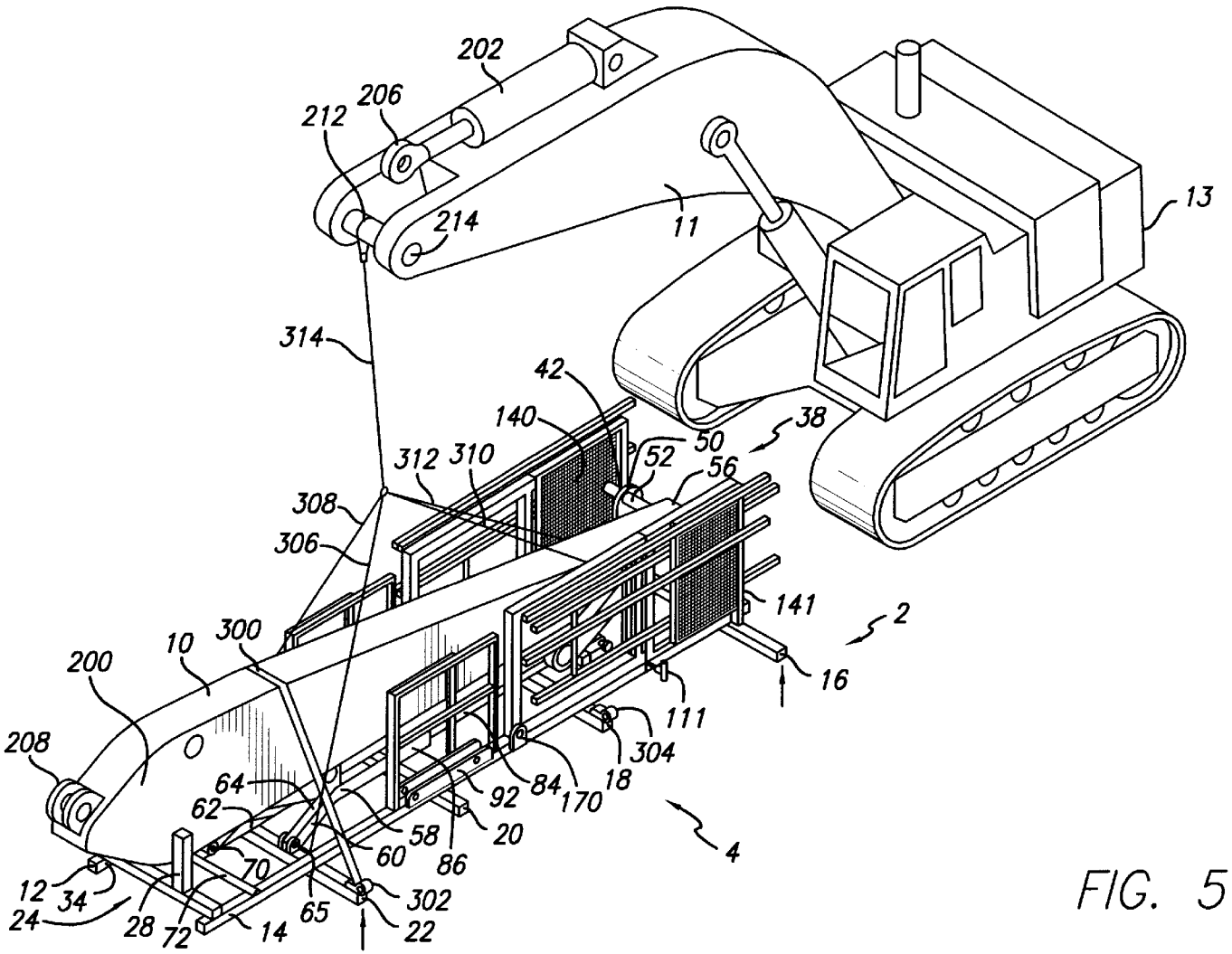
FIG. 5 is a perspective view of the excavator and the apparatus of FIG. 4 in the final stage of preparing an excavator stick for transport in accordance with the present invention.

Base 4 is also provided with a pair of hinges 170, 172 preferably welded to rails 14, 12, respectively, proximate to welded brackets 92, 90 (FIG. 1) and corresponding hinge pins such as hinge pin 171 for hinge 170 (hinge pin for hinge 172 not shown) (FIG. 1) for pivotally mounting the other end of platform base support frames 96, 94 to base 4. The preferred approximate range of angular motion is 0°–90°, i.e. platform base support frame 96 is at about 0° angular displacement relative to rail 14 when it is lying on top of rail 14, as shown in FIG. 5, and it is at about 90° angular displacement relative to rail 14 when platform base support frame 96 is fully extended away from rail 14 as shown in FIGS. 1–4 by a mechanic. Platform base support frame 94 is pivotally mounted and moves angularly in a similar manner.

Each platform base support frame also preferably includes a pair of symmetrically spaced generally circular apertures such as apertures 106, 108 for frame 94 and aperture 107 for frame 96 (second aperture not shown) for accommodating a pair of corresponding removable platform base hitch pins such as hitch pin 110 for frame 94 (second hitch pin not shown) and platform base hitch pins 111, 113 for frame 96. The hitch pins are needed for removably engaging a pair of platform base extension support frames such as platform base extension support frame 114 which is adapted to slide inside frame 94 and platform base extension support frame 115 which is adapted to slide inside frame 96 as shown in FIG. 1. Each extension support frame has generally a rectangular cross section and is constructed of a pair of long support bars such as bars 116, 118 for extension frame 114 and bars 117, 119 for extension frame 115 supported by a pair of short cross support members 120, 122 and 121, 123, respectively (FIG. 1). Each long support bar (116, 118) and (117, 119) is provided at the bottom end with a generally circular aperture such as aperture 124 on long support bar 116 (second aperture not shown) for removably engaging platform base hitch pin 110 and aperture 126 on long support bar 117 (second aperture not shown) for removably engaging platform base hitch pin 111 to secure each platform (6, 8) in its fully erected state. Long support bars (116, 118) are designed to slide telescopically inside hollow support bars 98, 100 so that extension frame 114 can be easily collapsed by a mechanic inside frame 94 with the section (of extension frame 114) defined between cross support bar 120 and cross support bar 122 left out. The collapsed section of extension frame 114 is secured to frame 94 via a pair of generally circular apertures such as aperture 3 on long support bar 118 with each aperture adapted to receive the corresponding hinge pin after aperture 3 is aligned by the mechanic with aperture 108. Extension frame 115 can be telescopically collapsed by a mechanic inside frame 96 in a similar manner. Specifically, the collapsed section of extension frame 115 is secured to frame 96 via a pair of generally circular apertures such as aperture 5 on long support bar 117 with each aperture adapted to receive the corresponding hinge pin after aperture 5 is aligned by the mechanic with aperture 107.

Each platform (6, 8) is also supported by a fold-away cross support frame such as cross support frame 130 for platform 6 and cross support frame 132 for platform 8 (FIG. 1). Cross support frame 130 comprises a pair of parallel long support bars 134, 136 supported by a short cross support bar 138 (FIG. 1). Cross support frame 132 comprises similarly a pair of parallel long support bars 133, 137 supported by a short cross support bar 139 (FIG. 1). Each platform also comprises a substantially rectangular steel deck equipped with a pair of generally rectangular-shaped removable guardrails such as deck 140 and guardrails 142, 144 of platform 6 and deck 141 and guardrails 143, 145 of platform 8. Guardrails 142, 144 are preferably secured to deck 140 via a pair of brackets and spring hitch pins (not shown). Guardrails 143, 145 are secured in the same manner. Guardrails 142, 144 and 143, 145 can be easily removed and stored as shown in FIG. 5 during transportation. Deck 140 is preferably hinged to short cross support bar 122 with a pair of conventional hinge brackets (not shown) and hinge pins (not shown) with the preferred approximate range of angular motion 0°–90°, i.e. deck 140 is at about 0° angular displacement relative to extension support frame 114 when it is lying on top of extension support frame 114 as shown in FIG. 5 and it is at about 90° angular displacement relative to extension support frame 114 when deck 140 is fully extended away from extension support frame 114 as shown in FIGS. 1–4. Deck 141 is hinged and moves angularly in a similar manner.

Cross support frame 130 is preferably hinged at one end to side 146 of deck 140 (FIG. 1) with a pair of conventional hinge brackets (not shown) and hinge pins (not shown) with an approximate range of angular motion 0°–180°, i.e. cross support frame 130 is at about 0° angular displacement relative to deck 140 when cross support frame 130 is lying on top of extension support frame 114 and lies substantially in the same plane as deck 140 (which is also lying on top of extension support frame 114 in this particular configuration) as shown in FIG. 5. Cross support frame 130 is displaced about 45° relative to deck 140 when deck 140 is fully extended, as shown in FIGS. 1–4, so as to provide structural support for fully extended deck 140. Cross support frame 132 is hinged and moves angularly in a similar manner. Long support legs 134, 136 of cross support frame 130 are removably pinned (using conventional spring hitch pins) by a mechanic to square tube pocket-type brackets (not shown) welded on cross support bar 120 to support fully extended deck 140. Similarly, long support legs 133, 137 of cross support frame 132 are removably pinned (using conventional spring hitch pins) by a mechanic to square tube pocket-type brackets (not shown) welded on cross support bar 121 to support fully extended deck 141.

In addition, a heavy duty two-piece ladder is preferably included to provide easy access (for the mechanic) to each deck. For deck 140, a ladder 150 having a top ladder piece 152 slidably coupled to a bottom ladder piece 154 is shown in FIG. 1. One end of top ladder piece 152 is preferably provided with hook attachments (not shown) for removably engaging a side edge of deck 140 as shown in FIG. 1. Bottom ladder piece 154 is preferably secured to platform base support frame 94 by welding a side portion of ladder piece 154 to a pair of corresponding spaced apart hinges provided on long support bar 100 (not shown) of platform base support frame 94 (FIG. 1). When ladder 150 is not in use, top ladder piece 152 conventionally slides down over bottom ladder piece 154. Similarly, for deck 141, a ladder 151 having a top ladder piece 153 slidably coupled to a bottom ladder piece 155 is shown in FIG. 4. One end of top ladder piece 153 is preferably provided with hook attachments (not shown) for removably engaging a side edge of deck 141 as shown in FIG. 4. Bottom ladder piece 155 is preferably secured to platform base support frame 96 by welding a side portion of ladder piece 155 to a pair of corresponding spaced apart hinges provided on long support bar 173 (not shown) of platform base support frame 96 (FIG. 1). When ladder 151 is not in use, top ladder piece 153 conventionally slides down over bottom ladder piece 155.

The above-described components of apparatus 2 may be made of cold rolled steel. Other materials may be used to manufacture the novel apparatus, as well as other assembly methods may be employed provided such materials and assembly methods do not depart from the intended purpose and scope of the present invention.

Apparatus 2 may be brought to a job site in a partially assembled state and then readily assembled by a crew of two men (a mechanic and an excavator operator) in a series of steps. The first step is setting base 4 of apparatus 2 on level ground proximate to excavator 13 which has boom 11 and excavator stick 10 uncoupled from the excavator bucket. The next step is lifting top ladder piece 152 high enough to swing out manually deck 140 and then pin long support legs 134, 136 of fold-away cross support frame 130 to the corresponding brackets provided on cross support bar 120. The excavator operator then lifts deck 140 (with long support bar 101 pivoted on pin 171 of bracket 170—FIG. 1) approximately 2–3 feet off the ground using a cable/chain attached between the chained bucket linkage and deck 140 to allow mounting of guardrails 142, 144 onto deck 140 by the mechanic. The mechanic mounts guardrails 142,144 in corresponding brackets provided on deck 140 using spring hitch pins (not shown). With the guardrails secured, the excavator operator lifts deck 140 to a fully upright position (approximately 90°—see FIG. 1) and the mechanic secures the other end of bottom platform support frame 94 in bracket 93 via bolt/nut. The next step is removing the platform base hitch pins (e.g. platform base hitch pin 110) by the mechanic to allow the excavator operator to fully extend extension support frame 114 using excavator 13, the cable/chain still attached between the chained bucket linkage and deck 140. The mechanic then secures fully extended extension support frame 114 with the hitch pins, the set up of platform 6 now being complete. Platform 8 can be set up in a similar manner.

In accordance with the best mode for practicing the present invention, excavator stick 10 is prepared for transport using apparatus 2 in a series of steps preferably by a crew of two men (a mechanic and an excavator operator) assuming apparatus 2 is on the job site in a fully assembled state with base 4 placed on level ground proximate to hydraulic excavator 13 with boom 11 hinged to back end 200 of excavator stick 10 (FIG. 2). Front end 56 of excavator stick 10 is unhinged from the excavator bucket as described hereinabove.

As generally shown in FIGS. 2–5, the excavator operator lowers excavator stick 10 between platforms 6, 8 to allow the mechanic who is positioned on top of deck 140 (or deck 141) to block a stick cylinder 202, remove a stick cylinder pin 204 from stick cylinder head 206, retract stick cylinder 202 and disconnect the hoses from boom 11 (not shown). The mechanic then partially inserts stick cylinder pin 204 back in stick cylinder pin support ears 208, loops one end of a heavy duty, preferably, 5-ton steel cable 210 around partially inserted stick cylinder pin 204, pushes stick cylinder pin 204 fully back in stick cylinder pin support ears 208 securing one end of steel cable 210 to stick cylinder pin 204 (FIG. 4) and climbs down ladder 150 or ladder 151 depending on which platform (6,8) is being used. The excavator operator then raises boom 11 (boom 11 is hinged to excavator stick 10 via boom pin 212—FIG. 2) as needed to align excavator stick point pin aperture 54 on front end 56 of excavator stick 10 with excavator stick point pin 52 which is shown partially inserted in bracket plate aperture 48 in FIG. 2. Once pin 52 is aligned with aperture 54, the mechanic pushes pin 52 in to secure front end 56 of excavator stick 10 in excavator stick point support bracket 38 (FIG. 3) after which the excavator operator lowers boom 11 to prepare boom 11 for the next step. If excavator stick support member 58 is in a collapsed state (i.e., not fully extended), the mechanic slides extendible leg 84 out of hollow base member 86 and attaches the same with a conventional nut/bolt connection 88 (FIG. 1)—excavator stick support member 58 now being fully extended. The mechanic then raises fully extended excavator stick support member 58 about 45–50 degrees relative to base 4 (FIG. 2) using integrated come-along 70 to set fully extended fork-shaped excavator stick support member 58 in a position proximate to excavation stick support eye region 68. The excavator operator adjusts the position of excavator stick 10 to align both sides of excavator stick support eye region 68 within apertures 78, 80 of excavator stick support bracket 66 to allow insertion of excavator stick support bracket pin 82 (FIG. 3) by the mechanic to secure excavator stick 10 to excavator stick support member 58.

Having secured excavator stick 10 via excavator stick support bracket pin 82, the mechanic disconnects the hoses for the bucket cylinder (not shown) and blocks off the hydraulic lines (not shown). The mechanic then uses a hydraulic pin press (not shown) to pull boom pin 212 out enough to allow unhinging of boom 11 from excavator stick 10 (FIG. 3). With boom 11 unhinged from excavator stick 10, the excavator operator raises boom 11 approximately one foot above excavator stick 10, which is being supported by excavator stick support member 58, to allow the mechanic who is positioned on one of the decks (140, 141) to loop the other end of steel cable 210 on boom pin 212. After that boom pin 212 is re-inserted in boom pin support ears 214 (FIG. 3) by the mechanic providing a cable connection between boom 11 and back end 200 of excavator stick 10 (FIG. 4) and the mechanic climbs about half-way down ladder 150 or ladder 151 depending on which platform (6,8) is being used.

The excavator operator then raises boom 11 to put tension on steel cable 210 lifting slightly excavator stick 10 to allow manual removal of excavator stick support bracket pin 82 from excavator stick support eye region 68. The mechanic then leans over from his half-way down position on ladder 150 (or ladder 151) and pulls excavator stick support bracket pin 82 out decoupling excavator stick support member 58 from excavator stick 10, excavator stick 10 being supported by boom 11 via cable. Once excavator stick support bracket pin 82 is out, the mechanic hand signals to the excavator operator to raise excavator stick 10 about two feet up from its previous position. The mechanic then climbs down the ladder and lowers excavator stick support member 58 to a resting position on top of cross support members 18, 20 of base 4 using come-along 70. The mechanic then precision positions saddle 24, which is adapted for slip fit coupling with rails 12, 14 as described hereinabove, to receive back end 200 of excavator stick 10. The excavator operator then gradually lowers back end 200 of excavator stick 10 to a resting position onto saddle 24 (FIGS. 4, 5). With back end 200 securely resting onto saddle 24, the mechanic climbs back up ladder 150 (or ladder 151) on deck 140 (or deck 141) and manually pulls boom pin 212 enough to release the end loop of cable 210. A person skilled in the art would appreciate that at this point there is no weight on boom pin 212, i.e. boom pin 212 can be easily pushed or pulled manually by the mechanic. The mechanic then reinserts boom pin 212 in boom pin support ears 214 and climbs down ladder 150 (or ladder 151).

Once on the ground, the mechanic straps excavator stick 10 to base 4 using an industrial strength strap 300 (FIG. 5) which is coupled between a ratchet 302 mounted preferably at one end of cross support bar 22 and a hook 303 (FIGS. 1–4) mounted preferably on the opposite end of cross support bar 22. An extra ratchet 304 and a corresponding hook (not shown) are provided on cross support bar 18 as shown on FIG. 5 if additional strapping is desired.

Next, the mechanic lowers platforms 6, 8 for storage on each side of base 4 (FIG. 5) by reversing the procedural steps described hereinabove regarding assembly of apparatus 2. With platforms 6, 8 in stored position, the hinged ladders (in the folded over position) lock platforms 6, 8 in place, apparatus 2 being now essentially in a partially assembled state.

The mechanic hooks one end of a steel cable 314 to boom pin 212 (which is accomplished in a manner similar to the one described above) with the other end of cable 314 being provided with four diverging steel cables 306, 308, 310, 312 which attach respectively to corresponding hooks welded on cross support bars 22, 16 inside of rails 12, 14 as shown in FIG. 5. Once cables 306, 308, 310, 312 are securely attached to base 4, the excavator operator lifts the entire structure (base 4 containing strapped excavator stick 10—FIG. 5) for placement onto a trailer or the like for transporting the structure to another location.

Once at the new location, excavator stick 10 may be readily prepared for use by a crew of two men (a mechanic and an excavator operator) by generally reversing the order of procedural steps outlined hereinabove in reference to FIGS. 5, 4, 3 and 2.

It should be appreciated by a person skilled in the art that other components and/or configurations may be utilized in the above-described embodiments, provided that such components and/or configurations do not depart from the intended purpose and scope of the present invention.

While the present invention has been described in detail with regards to the preferred embodiments, it should be appreciated that various modifications and variations may be made in the present invention without departing from the scope or spirit of the invention. In this regard it is important to note that practicing the invention is not limited to the applications described hereinabove. Many other applications and/or alterations may be utilized provided that they do not depart from the intended purpose of the present invention.

It should be appreciated by a person skilled in the art that features illustrated or described as part of one embodiment can be used in another embodiment to provide yet another embodiment such that the features are not limited to the specific embodiments described above. Thus, it is intended that the present invention cover such modifications, embodiments and variations as long as they come within the scope of the appended claims and their equivalents.

What is claimed is:

1. An apparatus for preparing an excavator stick for transport, the excavator stick having a front portion uncoupled from an excavator bucket, a back portion removably coupled to an excavator boom, and an excavator stick support eye region between the front and back portions, said apparatus comprising:

(a) a base for accommodating and supporting the excavator stick during transport;

(b) means for removably coupling the front excavator stick portion to said base;

(c) means for uncoupling the back excavator stick portion from the excavator boom;

(d) means for supporting the uncoupled back portion of the excavator stick over said base;

(e) means for holding the uncoupled back portion of the excavator stick onto said base; and (f) means for securing the excavator stick to said base in preparation for transport.

2. The apparatus of claim 1, wherein said base comprises a plurality of substantially parallel rails coupled to a plurality of substantially symmetrically spaced cross support bars.

3. The apparatus of claim 2, wherein said removable coupling means at least one excavator stick point support bracket coupled to said rails at one end of said base and adapted to removably receive an excavator stick point pin and the front portion of the excavator stick, the front portion of the excavator stick being adapted to removably receive said excavator stick point pin within said at least one excavator stick point support bracket.

4. The apparatus of claim 3, wherein said supporting means includes at least one substantially fork-shaped excavator stick support member pivotally coupled at one end to one of said cross support bars of said base away from said at least one excavator stick point support bracket and comprising a plurality of substantially symmetrically spaced prongs adapted to support the uncoupled back portion of the excavator stick over said base.

5. The apparatus of claim 4, wherein said holding means includes at least one saddle removably coupled to said rails opposite said at least one excavator stick point support bracket and substantially behind said pivotally coupled end of said at least one substantially fork-shaped excavator stick support member and adapted to receive and hold the uncoupled back portion of the excavator stick onto said base.

6. The apparatus of claim 4, further comprising means for raising and lowering said at least one substantially fork-shaped excavator stick support member relative to said base.

7. The apparatus of claim 6, wherein said raising and lowering means includes at least one come-along coupled to said base generally behind said pivotally coupled end of said at least one substantially fork-shaped excavator stick support member.

8. The apparatus of claim 4, wherein each of said prongs includes an aperture adapted to receive a stick support pin for removably coupling said at least one substantially fork-shaped excavator stick support member to the excavator stick support eye region.

9. The apparatus of claim 8, further comprising means for lowering the uncoupled back portion of the excavator stick onto said at least one saddle after said stick support pin is uncoupled from said prongs and the excavator stick support eye region.

10. The apparatus of claim 9, wherein said lowering means comprises at least one cable removably coupled between the excavator boom and the uncoupled back portion of the excavator stick.

11. The apparatus of claim 2, wherein said uncoupling means comprises at least one work platform pivotally coupled at one end to at least one of said rails and raised proximate to the back excavator stick portion for use by a mechanic.

12. The apparatus of claim 2, wherein said securing means includes at least one ratchet with a strap and a corresponding hook generally disposed at each end of one of said cross support bars for securely strapping the uncoupled back portion of the excavator stick to said base.

13. The apparatus of claim 12, further comprising means for lifting the secured excavator stick onto a transport vehicle.

14. The apparatus of claim 13, wherein said lifting means includes at least one cable removably coupled between the excavator boom and said base.

15. The apparatus of claim 11, wherein said uncoupling means further comprises a hydraulic pin press for use by the mechanic while on said at least one work platform to remove a boom pin which couples the back portion of the excavator stick to the excavator boom.

16. A method for preparing an excavator stick for transport, the excavator stick having a front portion uncoupled from an excavator bucket, a back portion removably coupled to an excavator boom with a stick cylinder pin and a boom pin, and an excavator stick support eye region between the front and back portions, said method comprising the steps of:

(a) providing a base for accommodating and supporting the excavator stick during transport;

(b) mounting an excavator stick point support bracket to one end of the base for removably coupling the front portion of the excavator stick to the base;

(c) removably coupling a saddle to an opposite end of the base for receiving and holding the back portion of the excavator stick onto the base after the back excavator stick portion is uncoupled from the excavator boom;

(d) pivotally coupling a substantially fork-shaped excavator stick support member to the base between the saddle and the excavator stick point support bracket for supporting the back portion of the excavator stick over the base after the back excavator stick portion is uncoupled from the excavator boom;

(e) pivotally coupling at least one work platform to the base between the saddle and the excavator stick point support bracket;

(f) erecting said at least one pivotally coupled work platform on said base proximate to the removably coupled back excavator stick portion for use by a mechanic;

(g) positioning the front excavator stick portion within the excavator stick point support bracket for coupling thereto;

(h) removably coupling the front portion of the excavator stick to the excavator stick point support bracket;

(i) removing the stick cylinder pin to partially uncouple the back portion of the excavator stick from the excavator boom using said at least one erected work platform;

(j) raising the substantially fork-shaped excavator stick support member proximate to the excavator stick support eye region for coupling thereto;

(k) removably coupling the raised substantially fork-shaped excavator stick support member to the excavator stick support eye region using said at least one erected work platform;

(l) removing the boom pin to fully uncouple the back portion of the excavator stick from the excavator boom using said at least one erected work platform;

(m) using cable means to tie the uncoupled back excavator stick portion to the excavator boom;

(n) uncoupling the raised substantially fork-shaped excavator stick support member from the excavator stick support eye region using said at least one erected work platform;

(o) lowering the uncoupled substantially fork-shaped excavator stick support member onto the base;

(p) lowering the tied uncoupled back portion of the excavator stick onto the saddle;

(q) removing the cable means between the saddle-supported back portion of the excavator stick and the excavator boom;

(r) securing the excavator stick to the base;

(s) storing said at least one work platform on the base; and (t) removably coupling the base with the secured excavator stick and said at least one stored work platform to the excavator boom for lifting onto a transport vehicle.

17. The method of claim 16, wherein said step (m) includes the sub-steps of:

($m_1$) coupling the boom pin to the excavator boom;

($m_2$) coupling the stick cylinder pin to the uncoupled back portion of the excavator stick; and ($m_3$) tying at least one cable between the coupled boom pin and the coupled stick cylinder pin.

* * * * *